US011692348B1

(12) United States Patent
Warter

(10) Patent No.: US 11,692,348 B1
(45) Date of Patent: Jul. 4, 2023

(54) SYSTEM AND METHOD OF SECURING A ROOF TRUSS TO A LOAD-BEARING WALL

(71) Applicant: S.W. Engineering Inc., Delray Beach, FL (US)

(72) Inventor: Stephen W. Warter, Delray Beach, FL (US)

(73) Assignee: S.W. Engineering Inc., Delray Beach, FL (US)

( * ) Notice: Subject to any disclaimer, the term of this patent is extended or adjusted under 35 U.S.C. 154(b) by 50 days.

(21) Appl. No.: 17/331,068

(22) Filed: May 26, 2021

(51) Int. Cl.
*E04B 7/04* (2006.01)
*E04B 1/21* (2006.01)

(52) U.S. Cl.
CPC ..... *E04B 7/045* (2013.01); *E04B 1/215* (2013.01)

(58) Field of Classification Search
CPC ..... E04B 7/045; E04B 1/215
USPC ..... 52/92.2
See application file for complete search history.

(56) References Cited

U.S. PATENT DOCUMENTS 1,833,692 A * 11/1931 Silvio ..... A47C 19/025 29/897
4,410,294 A * 10/1983 Gilb ..... F16B 9/058 403/403
5,109,646 A * 5/1992 Colonias ..... E04B 1/2608 403/402
5,240,342 A * 8/1993 Kresa, Jr. ..... F16B 9/058 403/403
5,335,469 A * 8/1994 Stuart ..... E04B 7/045 52/645
5,448,871 A * 9/1995 Newman ..... E04B 7/04 52/712
5,497,593 A * 3/1996 Riesberg ..... E04B 5/12 D8/382
5,560,156 A * 10/1996 McDonald ..... E04B 1/2608 52/715
5,870,861 A * 2/1999 Gnaedinger ..... E04B 7/04 52/DIG. 11
5,901,522 A * 5/1999 Slater ..... E04B 1/24 52/645
6,295,781 B1 * 10/2001 Thompson ..... F16B 9/058 52/715
6,772,570 B2 * 8/2004 Horne ..... E04B 7/06 52/715
6,837,019 B2 * 1/2005 Collie ..... E04B 7/045 52/489.1

(Continued)

*Primary Examiner* — Brian D Mattei
*Assistant Examiner* — Joseph J. Sadlon
(74) *Attorney, Agent, or Firm* — Nancy J. Flint, Attorney At Law, P.A.; Nancy Flint

(57) ABSTRACT

A system and method for securing a roof truss to a load bearing wall is disclosed. A strap is attached to a roof truss at one end and extended to the top of a load-bearing wall. A buckle is placed over the strap to pinch the strap between the vertical and horizontal arms of the buckle. The end of the strap is wrapped back toward the vertical side of the roof truss and a flat plate is placed to pinch the free end of the strap between the buckle and the flat plate. Screws are placed through holes in the flat plate and corresponding holes in the buckle to attach the system to the top of the load-bearing wall. The system and method of the invention provides both horizontal (lateral) resistance and uplift resistance, thus resisting horizontal (lateral) forces while at the same time providing uplift resistance.

12 Claims, 10 Drawing Sheets

(56) References Cited

U.S. PATENT DOCUMENTS

| | | | | |
|---|---|---|---|---|
| 6,922,967 | B2 * | 8/2005 | Collie | E04B 7/063 52/715 |
| 6,931,813 | B2 * | 8/2005 | Collie | E04B 7/063 52/713 |
| 7,200,972 | B1 * | 4/2007 | Freeman | F16B 15/0046 52/712 |
| 7,716,877 | B2 * | 5/2010 | Gilstrap | F16B 9/058 403/DIG. 15 |
| 8,109,124 | B2 * | 2/2012 | Lin | B21C 47/28 72/274 |
| 8,615,935 | B1 * | 12/2013 | Calini | E04B 7/04 52/93.2 |
| 8,646,222 | B2 * | 2/2014 | Carbonaro | E04B 1/38 52/92.1 |
| 9,175,472 | B1 * | 11/2015 | Calini | E04B 1/40 |
| 9,932,735 | B1 * | 4/2018 | Biasucci | E04B 1/2612 |
| 10,100,518 | B2 * | 10/2018 | Smith | E04G 21/1841 |
| 10,779,481 | B2 * | 9/2020 | Spreen | A01G 17/12 |
| 10,858,819 | B2 * | 12/2020 | Styrc | E04B 1/0046 |
| 11,118,349 | B2 * | 9/2021 | Montoya | A01G 17/12 |
| 2006/0059794 | A1 * | 3/2006 | Gilstrap | E04B 7/045 52/90.1 |
| 2011/0225924 | A1 * | 9/2011 | Carbonaro | E04B 1/26 52/698 |

* cited by examiner

PRIOR ART

SYSTEM AND METHOD OF SECURING A ROOF TRUSS TO A LOAD-BEARING WALL

FIELD OF THE INVENTION

The invention relates to a system and method for securing a roof truss to a load bearing wall. A strap for securing a roof truss to a load-bearing wall is attached to the roof truss at one end and extended to the top of a load-bearing wall. A buckle having a vertical arm, a horizontal arm and a flat connector is placed over the exposed surface of the strap located at the top of the load-bearing wall such that the free end of the strap is pinched between the vertical side of the roof truss and the vertical arm, and top surface of the load-bearing wall and the horizontal arm. The free end of the strap is wrapped around the buckle and a top plate is placed on top of the flat connector, pinching the strap between the buckle and the top plate. Screws are placed through holes in the flat plate and corresponding holes in the buckle to attach the system to the top of the load-bearing wall. The system and method of the invention provides both horizontal (lateral) resistance and uplift resistance, thus resisting horizontal (lateral) forces while at the same time providing uplift resistance.

BACKGROUND OF THE INVENTION

Wood structures predominate in residential and light commercial construction. When wood framing is used the structure must be protected from upward loads developed by high wind, which differs with geographical location and is enforced by different building codes for such areas. Wind uplift is created when the air pressure below the roofing system is higher than the air pressure above the roof. When the wind blows over a roof's surface, the air pressure directly above the roof decreases, causing "negative" pressure. At the same time, the wind causes air infiltration below the roof materials through openings and cracks that create a "positive" pressure. The combination of negative pressure above and positive pressure below the roofing surface materials results in a "push-pull" force working together to separate the roofing materials from the roof deck. fast-moving exterior air flows over and around the building, creating a reduced pressure, or suction. The reduced pressure is lower inside the building, which is increased by air flowing through the building openings. When the interior positive pressure is added to negative exterior pressure created by high velocity winds, "ballooning" or uplift of the membrane may occur. The differential pressures are most severe at corners and perimeters.

Wind uplift is affected by:

- Building height: Higher roofs experience stronger wind velocities.
- Geographical location: Wind maps for any region can identify the local basic wind speed gust exposures to determine typical wind conditions for your home.
- Surrounding terrain: Neighboring buildings and other obstructions can break wind flow and reduce the wind effect in suburban and urban locations. Stronger wind resistance is required for roofs near large bodies of water or open terrain.
- Building openings: Openings in the building design can create higher internal pressures in a wind event.

Roof systems are the largest exterior building component exposed to weather and the elements. The function of a roof is to protect the building's interior components from these elements. Roof system attachment is a critical element of roof design and application. Improper attachment results in the increased probability of wind blow-offs and contributes to membrane strain created by differential movement of the system components. The design and application methods must address attachment of the total system and all the components, including the substrate, roofing, flashing, metal coverings and penetrations. The most prevalent element that proper attachment will deter is damage from wind force, particularly wind uplift damage.

Modern wood roofs are mostly framed with pairs of common rafters or prefabricated wooden roof trusses fastened together with truss connector plates. In high wind areas, such as where a cyclone or hurricane may make landfall, the main engineering consideration is to hold the roof down during severe storms. This is accomplished by using metal ties (straps) that fasten each rafter or roof truss to a supporting (load-bearing) wall.

Common straps that are used today include twist metal straps such as the HTWM Series Masonry Strap by USP Structural Connectors. The twist metal strap made of 14 gauge steel is attached to either side of grouted masonry or concrete wall with 4 wedge bolts, and attached to the roof truss with 8 10 d×1½ nails. The twist metal strap does not have to be wrapped over the roof truss to achieve the allowable load.

Straight straps are also used today, such as strap ties made by Simpson Strong-Tie for uplift applications. For example, MSTAM/MSTCM Strap Ties made from 18 gauge or 16 gauge steel are designed for wood-to-masonry applications. The ties are attached to the wooden roof truss using 9 to 13 to 26 nails size 0.148×3 depending on the model, and are attached to masonry or concrete with 5 to 8 to 14½×2¼ bolts, again depending on the model.

Metal brackets may also be used to tie-down a roof member such as the HGAM Hurricane Gusset Angle for Masonry made by Simpson Strong-Tie. This gusset angle secures the bottom chord of a framing member to masonry. The gusset angle is made from 14 gauge galvanized steel and attaches to wood using 1½ inch connector screws and to masonry using Titen® 2 masonry screws.

AU Patent No. 36753/78 discloses a support bracket for connecting an upper beam to a lower beam angled to it. The bracket includes a web portion, two end portions with each end portion integral with or otherwise connected to respective ends of the web portion, and each end portion having an outwardly projecting flange extending therefrom, whereby in use the web portion engages with a top face of the upper beam, each end portion engages with and extends beyond each side face of the upper beam and both of the flanges engage with a face of the lower beam.

AU Patent Appln. No. 2011202882 discloses a bracket for tie-down of a roof member, the bracket comprising a bearing portion and first and second pairs of openings which extend through the bracket, the openings of the second pair having a spacing which is greater than the spacing of the openings of the first pair, whereby the bracket can be mounted such that the bearing portion is received flat against the roof member and threaded upper ends of the rods are received through the openings of either the first pair or the second pair to receive threaded elements for effecting tight engagement between the bracket and rods and thus clamping of the roof member between the bearing portion and the structure to tie down the roof member.

DE 202014100979 discloses an angular connector for connecting two components, in particular wooden building components, comprising a cross-sectional L-shaped angle member, the L-formed by a first and a second angular element portion, each having a first and a second planar side, each vertical surface extending to the cross-section, wherein the first flat side of the angle member portions opposite each other and point towards the inside of the L-shape.

U.S. Pat. No. 4,022,537 discloses a knee brace to provide lateral resistance at the bottom of glued laminated beams and solid heavy timbers, the brace consisting of an elongated strap connected at its mid-point to the bottom of the heavy timber.

U.S. Pat. No. 4,527,375 discloses an anchor bracket for installation in newly constructed decks to resist warping or in existing decks where warping has already occurred, the bracket including a plate body portion which transversely spans abutting end portions of deck boards and a pair of depending bifurcated extensions on each end of the plate body portions which straddle the underlying support beams or joists of the deck structure.

U.S. Pat. No. 4,592,186 discloses an anchor for deck boards resting on a truss which include a deck board hold-down element, a truss-engaging resistance element and a threaded adjustable connector between the hold-down element and the resistance element.

U.S. Pat. No. 5,448,871 discloses a continuous narrow, elongated metal member bent to form a strap for holding a truss, the strap having a saddle portion to fit over the truss and two arms diverging therefrom to lie flat against the plates upon which the truss is supported.

U.S. Pat. No. 5,560,156 discloses a hurricane tie-down member formed of a unitary flat metallic preform to restrain roof trusses experiencing a high wind condition by transferring dynamic roof uplift forces from a planar saddle portion to a vertical wall via a pair of side arm members and flat anchor surfaces.

U.S. Pat. No. 6,837,019 discloses a building roof tie for attaching roof trusses and rafters to wood top plates, the roof tie having a sheet metal body with risers and a bridge for overlapping a rafter and flaps for wrapping on the sides of the top plate. U.S. Pat. No. 7,665,253 discloses a retrofit hurricane and earthquake clip for connecting the roof to the outside wall, the metal connector including a base member with formed pockets that form tunnels, the base member further having attaching means to outside sheathing and the underlying top plate of a wall, wherein threaded rods from the roof are inserted through the tunnels of the base member and tightened together.

SUMMARY OF THE INVENTION

The invention relates to a system and method of securing a roof truss to a load bearing wall.

In one embodiment, the system comprises an angled strap for securing a second structural roof member, such as a roof truss, to a first structural roof member, such as a load-bearing wall. The angled strap is substantially flat and comprises a flat central portion and two arms disposed at a substantially 22-degree bend from the flat central portion which allows the arms of the angled strap to extend almost vertically straight when installed over the top of the second structural roof member. The flat central portion of the angled strap is secured to the top of the second structural roof member and each free end of the arms of the angled strap extends downward along each vertical side of the second structural roof member to the top of the first structural roof member. Each free end of the angled strap is then extended horizontally along the top surface of the first structural roof member, one on each side of the second structural roof member.

In one embodiment, the system comprises a buckle and a top plate, where the buckle comprises a bracket with a vertical arm and a horizontal arm connected by a flat connector, where the flat connector is disposed at an angle to both the vertical arm and the horizontal arm. One end of a straight strap is attached to the top of the vertical side of the second structural roof member and the free end of the straight strap is extended down the second structural roof member and along the top surface of the first structural roof member. The buckle is placed at the intersection of the first structural roof member such that the free end of the straight strap is pinched between the vertical arm of the buckle and the vertical side of the second structural roof member, and also is pinched between the horizontal arm of the buckle and the top of the first structural roof member. The free end of the straight strap is then extended back toward the second structural roof member over the exposed surface of the horizontal arm of the buckle, whereupon the top plate is placed on the flat connector such that it pinches the free end of the straight strap between the top plate and the flat connector. The top plate is then attached to the first structural roof member by suitable connectors, such as wedge bolts, nails or screws, that extend through holes in the top plate and corresponding holes in the flat connector.

In one embodiment, the system comprises an angled strap, two (2) buckles as previously described and two (2) top plates as previously described. The angled strap is as previously described except that the free arms of the angled strap that extend to the top of the first structural roof member do not comprise holes for attachment, but rather are solid. Each free arm of the angled strap extends downward along each vertical side of the second structural roof member to the top of the first structural roof member as previously described. Each free end of the angled strap is then pinched between the vertical surface of the second structural roof member and a vertical arm of a buckle, and also between the horizontal top surface of the first structural roof member and a horizontal arm of a buckle. The free end of each arm of the angled strap is then extended back toward the second structural roof member over the exposed surfaces of the horizontal arm of each buckle, whereupon a top plate is placed on top of the flat connector of each buckle such that each free end of the straight strap is pinched between the flat connector and top plate of each buckle. Each top plate is then attached to the first structural roof member by suitable connectors, such as wedge bolts, nails or screws, that extend through holes in each top plate and corresponding holes in each flat connector.

The first structural roof member may comprise a load-bearing wall which comprises a top plate (if wood) or concrete (if a tie beam). The second structural roof member may comprise a roof truss.

BRIEF DESCRIPTION OF THE DRAWINGS

The invention will be more readily understood from the following detailed description of the various aspects of the invention taken in conjunction with the accompanying drawings in which.

DETAILED DESCRIPTION OF THE INVENTION

Figure 1:
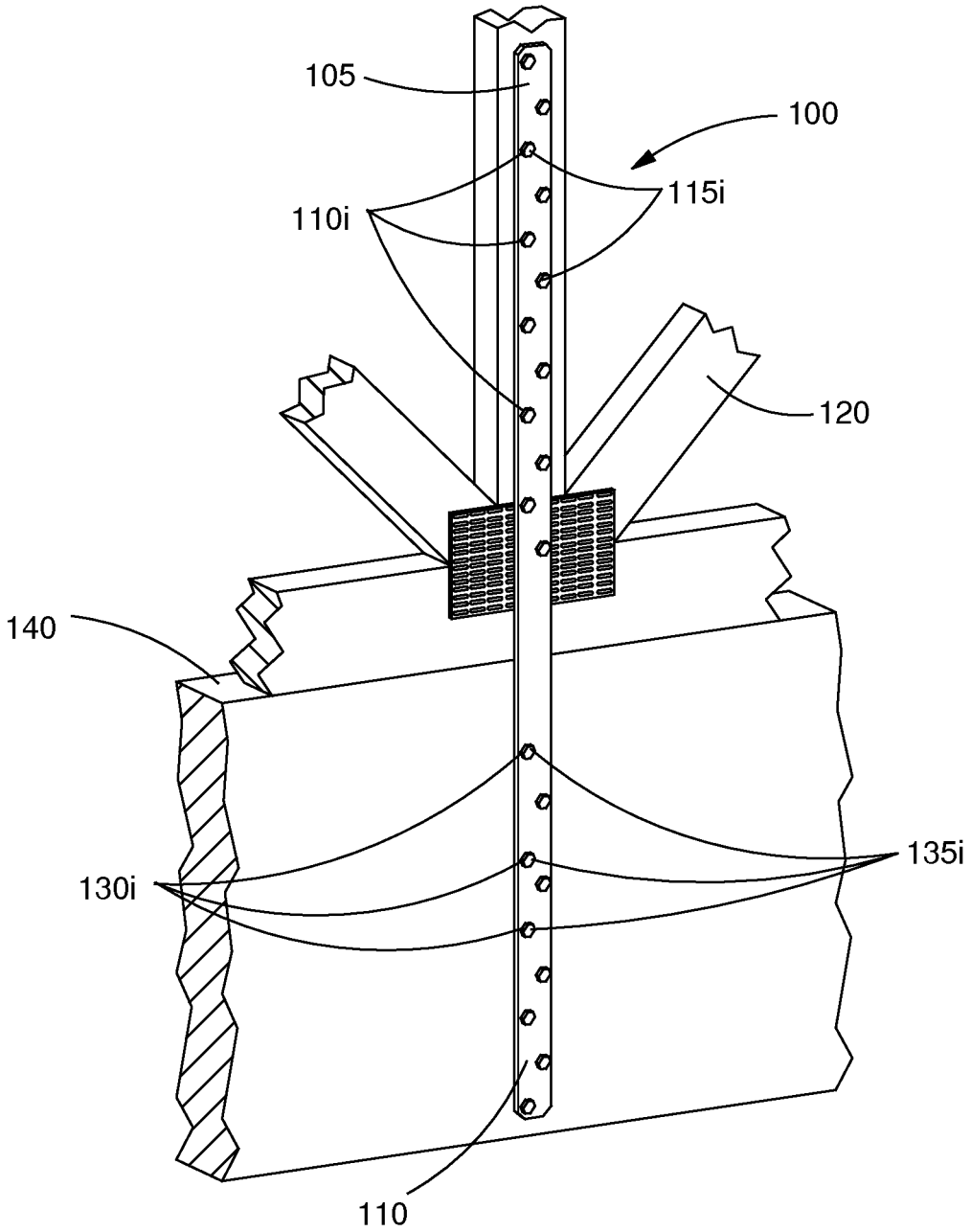
FIG. 1 depicts a side view of a straight strap as is known in the art.

The invention relates to a system and method of securing a roof truss to a load bearing wall. The strap and buckle comprising the invention when combined provide both horizontal (lateral) resistance and uplift resistance, thus resisting horizontal (lateral) forces while at the same time providing uplift resistance.

In one embodiment, the system comprises an angled strap for securing a second structural roof member, such as a roof truss, to a first structural roof member, such as a load-bearing wall. The angled strap is substantially flat and comprises a flat central portion and two arms disposed at a substantially 22-degree angle from the flat central portion which allows the angled strap to extend almost vertically straight when installed over the top of the second structural roof member. The flat central portion of the angled strap is secured to the top of the second structural roof member and each free end of the angled strap extends downward along opposing vertical sides of the second structural roof member to the top of the first structural roof member. The angled strap may comprise 14 gauge-20 gauge steel. The angled strap may be galvanized.

In one embodiment, the angled strap is approximately 1¼ inches wide and the substantially flat central portion is about 1½ inches long to fit over the top of a 2×6 wood roof truss which is approximately 1½ inch wide. Such an angled strap can be used for up to a 6/12 roof pitch. In one embodiment, the length of the substantially flat central portion is 3 inches and 3¼ inches wide to fit over the top of two standard roof trusses that have been attached to each other. In other embodiments, the length of the substantially flat portion of the angled strap and the width of the angled strap varies vary according to the size of the roof truss. In other embodiments, the angle of the arms of the angled strap and the substantially flat central portion can be greater than 22 degrees for roofs with pitch steeper than 6/12. The angled strap may comprise a plurality of holes for securing the angled strap to a roof truss, allowing for variations of the size of the roof truss.

In one embodiment, the system comprises a buckle and a top plate, where the buckle comprises a bracket with a vertical arm and a horizontal arm connected by a flat connector, where the flat connector is disposed at an angle to both the vertical arm and the horizontal arm.

In one embodiment, the vertical arm of the buckle is attached to the vertical side of a second structural roof member by inserting wedge bolts, nails, screws or other suitable connectors through predrilled holes in the vertical arm. In one embodiment, the horizontal arm of the buckle is attached to the top surface of a first structural roof member by inserting wedge bolts, nails, screws or other suitable connectors through predrilled holes in the horizontal arm. In one embodiment, the buckle and top plate are attached to the top surface of the first structural roof member by inserting wedge bolts, nails, screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws used to attach the buckle and top plate to the first structural roof member are approximately ¼" in diameter and the predrilled holes in the flat connector of the buckle are approximately 3⁄16" in diameter.

In one embodiment, the system comprises an angled strap, two (2) buckles as previously described and two (2) top plates as previously described. The angled strap is as previously described except that the arms of the angled strap that extend to the top of the first structural roof member do not comprise holes for attachment, but rather are solid. The flat central portion of the angled strap is attached to the top of the second structural roof member. Each arm of the angled strap is extended from each side of the second structural roof member to the top of a first structural roof member. A buckle is placed at each intersection of the first structural roof member, such as the top of a load-bearing wall, and each vertical side of the second structural roof member, such as the side of a roof truss, such that the horizontal arms of each buckle are placed on top of each of the extended arms of the angled strap along the horizontal top surface of the first structural roof member. The horizontal arm of each buckle is attached to the top of the first structural roof member on each side of the second structural roof member. The vertical arm of each buckle is attached to the side of the second structural roof member, pinching the extended arms of the angled strap between each vertical arm of the buckle and the vertical side of the second structural roof member, and between each horizontal arm of the buckle and the horizontal top surface of the first structural roof member. The free end of each arm of the angled strap is then extended back toward the second structural roof member over the exposed surfaces of each horizontal arm of each buckle. A top plate is placed over the free end of each arm of the angled strap such that it mates with the flat connector and pinches one arm of the angled strap between a top plate and a flat connector. Each top plate is then attached to the first structural roof member by connectors, such as screws, that extend through holes in each top plate and corresponding holes in each flat connector.

In one embodiment, the angled strap comprises 14 gauge-20 gauge steel. In one embodiment, the angled strap is galvanized. In one embodiment, the angled strap is approximately 1¼ inches wide and the substantially flat central portion is about 1½ inches long to fit over the top of a 2×6 wood roof truss which is approximately 1½ inch wide. Such an angled strap can be used for up to a 6/12 roof pitch. In one embodiment, the length of the substantially flat central portion is 3 inches and 3¼ inches wide to fit over the top of two standard trusses that have been attached to each other. In other embodiments, the length of the substantially flat portion of the angled strap and the width of the angled strap vary according to the size of the roof truss. In other embodiments, the angle of the arms of the angled strap and the substantially flat central portion can be greater than 22 degrees for roofs with pitch steeper than 6/12. The angled strap may comprise a plurality of holes for securing the strap to a roof truss, allowing for variations of the size of the roof truss. In one embodiment, the free ends of the first arm and second arm of the angled strap proximate the first structural roof member are solid. The absence of holes in the free ends of the first arm and the second arm of the angled strap proximate the load-bearing wall strengthens the angled strap because the angled strap has more cross-sectional area to resist tension due to uplift resistance. In one embodiment, the angled strap may comprise a plurality of holes at the free end of the arms to secure the angled strap to the top of a load-bearing wall.

In one embodiment, the vertical arm of the buckle is attached to the side of a second structural roof member by inserting screws or other suitable connectors through predrilled holes in the vertical arm. In one embodiment, the horizontal arm of the buckle is attached to the top surface of a first structural roof member by inserting screws or other suitable connectors through predrilled holes in the horizontal arm. In one embodiment, the buckle and top plate are attached to the top surface of the first structural roof member by inserting screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3⁄16" in diameter.

In one embodiment, the system comprises a straight strap, a buckle and a top plate as previously described. The straight strap is attached to the top of the second structural roof member and the free end of the straight strap extends to the top of a first structural roof member. A buckle is placed at the intersection of the first structural roof member, such as the top of a load-bearing wall, and the vertical side of the second structural roof member, such as the side of a roof truss, such that the horizontal arm of the buckle is placed on top of the free end of the straight strap along the horizontal top surface of the first structural roof member. The horizontal arm of the buckle is attached to the top of the first structural roof member on the side of the second structural roof member. The vertical arm of the buckle is attached to the side of the second structural roof member, pinching the free end of the straight strap between the vertical arm of the buckle and the vertical side of the second structural roof member, and between the horizontal arm of the buckle and the horizontal top surface of the first structural roof member. The free end of the straight strap is then extended back toward the second structural roof member over the exposed surfaces of the horizontal arm of the buckle. A top plate is placed over the free end of the straight strap such that it mates with the flat connector and pinches the free end of the straight strap between the top plate and the flat connector of the buckle. The top plate is then attached to the first structural roof member by connectors, such as screws, that extend through holes in the top plate and corresponding holes in the flat connector.

In one embodiment, the straight strap comprises 14 gauge-20 gauge steel. In one embodiment, the straight strap is galvanized. In one embodiment, the straight strap is approximately 1¼ inches wide. The straight strap may comprise a plurality of holes for securing the straight strap to a second structural roof member allowing for variations of the size of the second structural roof member. The straight strap may further comprise a plurality of holes for securing the straight strap to a first structural roof member allowing for variations of the size of the first structural roof member.

In one embodiment, the vertical arm of the buckle is attached to the side of a second structural roof member by inserting screws or other suitable connectors through predrilled holes in the vertical arm. In one embodiment, the horizontal arm of the buckle is attached to the top surface of a first structural roof member by inserting screws or other suitable connectors through predrilled holes in the horizontal arm. In one embodiment, the buckle and top plate are attached to the top surface of the first structural roof member by inserting screws or other suitable connectors through predrilled holes in each of the flat connector and the top plate, where the predrilled holes are substantially in alignment. In one embodiment, the screws or other suitable connectors that are used to attach the buckle and top plate to the first structural roof member are larger in diameter than the predrilled holes in the flat connector of the buckle. In one embodiment, screws are used to attach the buckle and top plate to the first structural roof member are approximately ¼" in diameter and the predrilled holes in the flat connector of the buckle are approximately 3⁄16" in diameter.

In one embodiment, the buckle and/or the top plate are fastened to the first structural roof member using tap-cons. In one embodiment, the extended arm of the angled strap is pinched between the top of the first structural roof member and the horizontal arm of a single buckle. In one embodiment, one or more nails are placed in the free end of the first arm and second arm of the angled strap, preventing the angled strap from slipping through the buckles and/or flat plate. The first structural roof member may comprise a load-bearing wall which comprises a top plate (if wood) or concrete (if a tie beam). The second structural roof member may comprise a roof truss.

Turning to the figures, FIG. 1 depicts a side view of a straight strap as is known in the art. Straight strap 100 comprises a first end 105 and a free end 110. First end 105 comprises a plurality of holes 110*i* through which a plurality of nails or other suitable connectors $\mathbf{115}_i$ are inserted to attach first end 105 to a second structural roof member, such as a roof truss 120. Free end 110 comprises a plurality of holes $\mathbf{130}_i$ through which a plurality of wedge bolts or other suitable connectors $\mathbf{135}_i$ are inserted to attach free end 110 to the top of a first structural roof member, such as a load-bearing wall 140.

Figure 2:
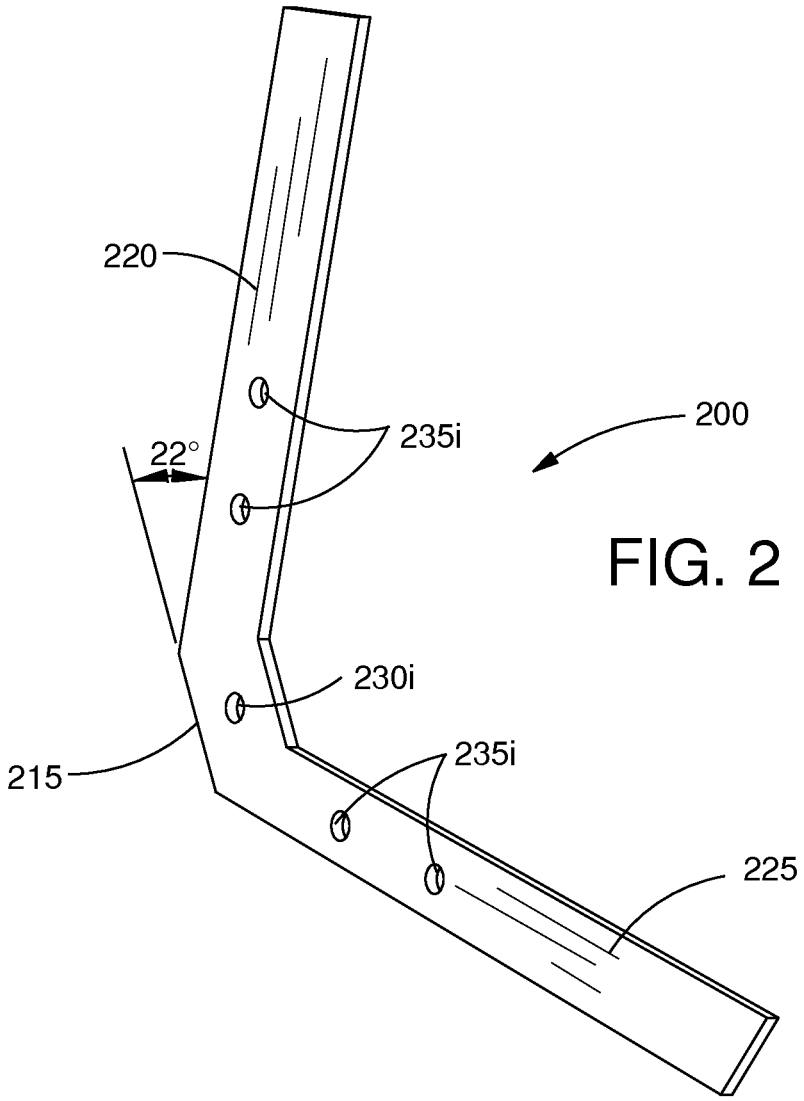
FIG. 2 depicts a perspective view of an angled strap according to one embodiment of the invention.

FIG. 2 depicts a perspective view of an angled strap 200 according to one embodiment of the invention. Angled strap 200 comprises a flat central portion 215, and a first arm 220 and a second arm 225 disposed at a substantially 22-degree angle from flat central portion 215. This angle allows angled strap 200 to extend almost vertically straight when installed over the top of a second structural roof member, such as a roof truss. Flat central portion 215 of angled strap 200 comprises one or more holes $\mathbf{230}_i$ through which wedge bolts, nails, screws or other suitable connectors are inserted to secure angled strap 200 to the top of a second structural roof member, such as a roof truss. First arm 220 and second arm 225 each comprise a plurality of holes $\mathbf{235}_i$ through which wedge bolts, screws, nails or other suitable connectors are inserted to secure angled strap 200 to the vertical side of a first structural roof member, such as a load-bearing wall.

Figure 3:
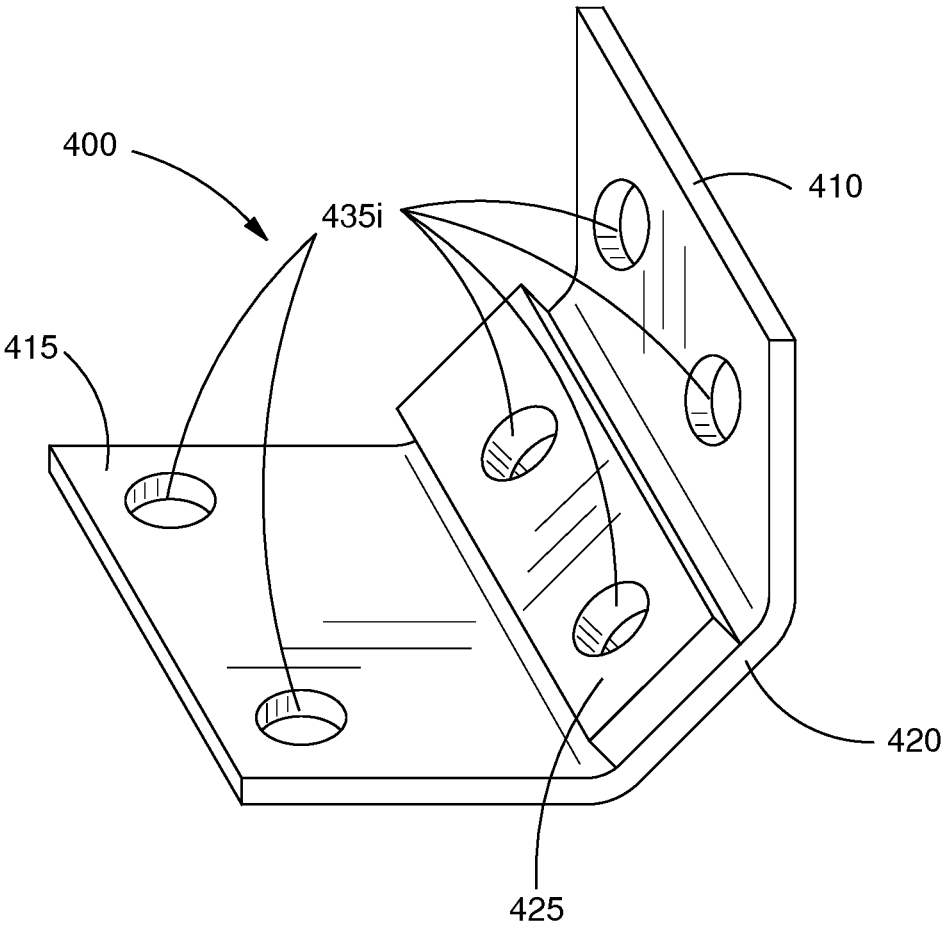
FIGS. 3 and 4 depict a buckle according to one embodiment of the invention.
Figure 4:
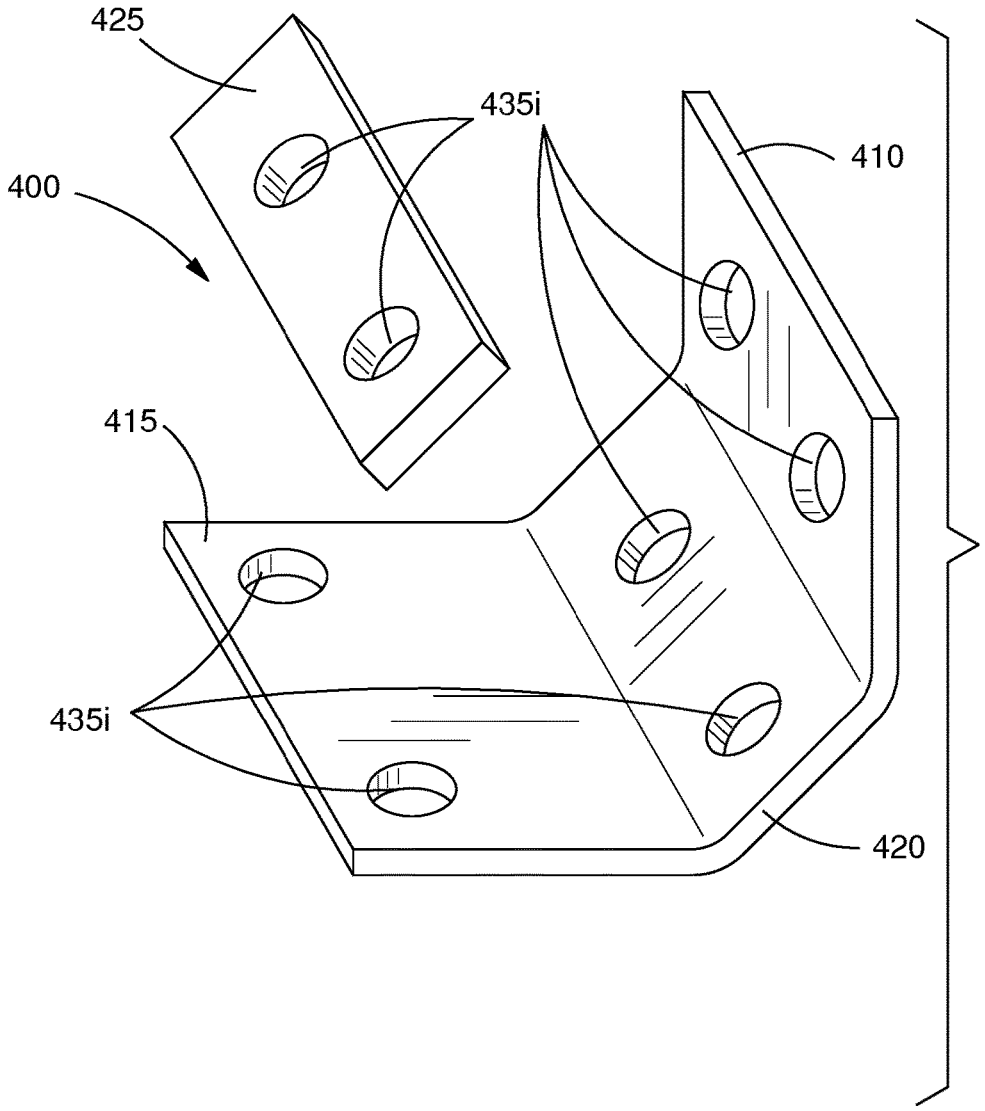

FIGS. 3 and 4 depict a buckle 400 according to one embodiment of the invention. Buckle 400 comprises a vertical arm 410 and a horizontal arm 415. Vertical arm 410 and horizontal arm 415 are connected by a flat connector 420, which is disposed at an angle to each of vertical arm 410 and horizontal arm 415. A top plate 425 is sized to mate with the top surface of flat connector 420. Holes $\mathbf{435}_i$ are disposed in vertical arm 410, horizontal arm 415, flat connector 420 and top plate 425 to attach buckle 400 to a second structural roof member, such as a roof truss, to a first structural roof member, such as a load-bearing wall.

Figure 5:
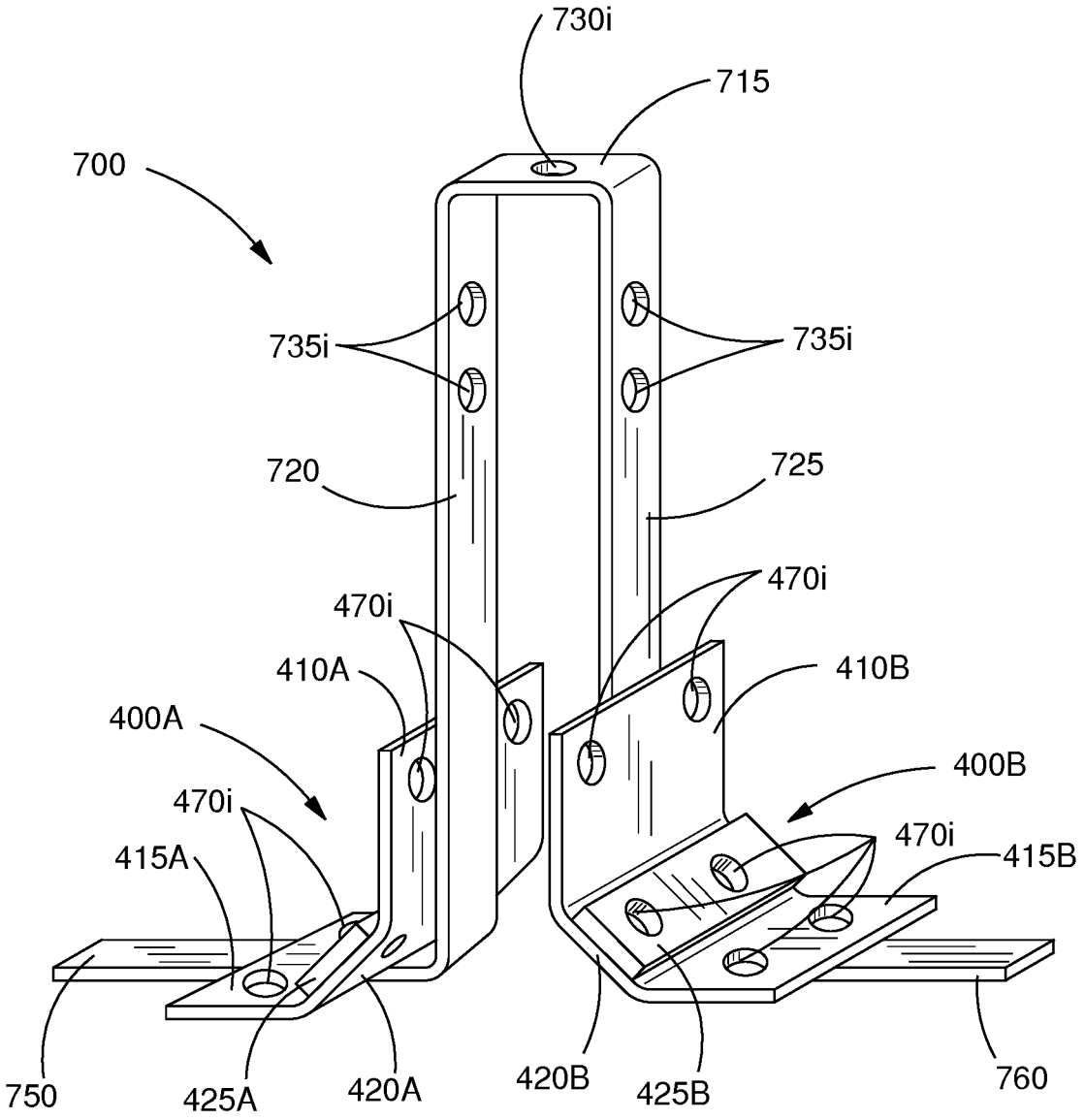
FIGS. 5 and 6 depict a system comprising an angled strap and two buckles to secure a roof truss to the top surface of a load-bearing wall according to one embodiment of the invention.
Figure 6:
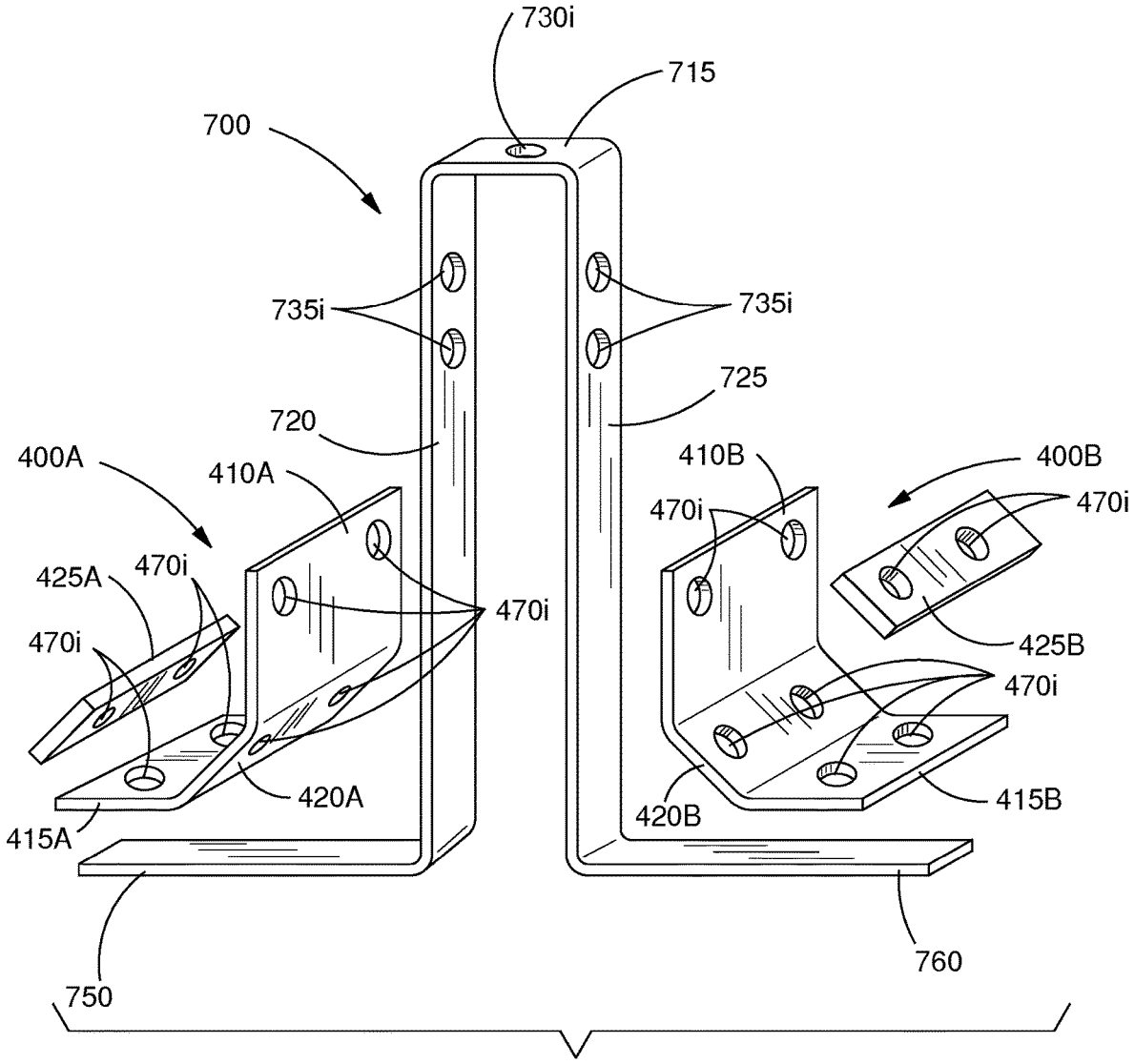

FIGS. 5 and 6 depict a system comprising angled strap 700 and two buckles 400A, 400B according to one embodiment of the invention for securing a second structural roof member, such as a roof truss, to a first structural roof member, such as a load-bearing wall. Angled strap 700 comprises a flat central portion 715, a first arm 720 having a first free end 750 and a second arm 725 having a second free end 760, where each of first arm 720 and second arm 725 are disposed at a substantially 22-degree angle from flat central portion 715 as seen in FIG. 2. This angle allows angled strap 700 to extend almost vertically straight when installed over the top of a second structural roof member, such as a roof truss. Flat central portion 715 of angled strap 700 comprises one or more holes $730_i$ through which wedge bolts, nails, screws or other suitable connectors are inserted to secure angled strap 700 to the top of the second structural roof member, such as a roof truss. First arm 720 and second arm 725 of angled strap 700 each comprise one or more holes $730_i$ through which wedge bolts, nails, screws or other suitable connectors are inserted to secure angled strap 700 to the vertical side of a second structural roof member, such as a roof truss. Buckles 400A, 400B each comprise a vertical arm 410A, 410B and a horizontal arm 415A, 415B. Vertical arms 410A, 410B and horizontal arms 415A, 415B are each connected by a flat connector 420A, 420B, respectively, which is disposed at an angle to each of vertical arm 410A, 410B and horizontal arm 415A, 415B. Top plates 425A, 425B are sized to mate with flat connectors 420A, 420B. Vertical arms 410A, 410B, horizontal arms 415A, 415B, flat connectors 420A, 420B and top plates 425A, 425B each comprise a plurality of holes $470_i$ through which connectors $475_i$ can be inserted to attached buckles 400A, 400B to a second structural roof member, such as a roof truss, and a first structural roof member, such as a load-bearing wall.

Figure 7:
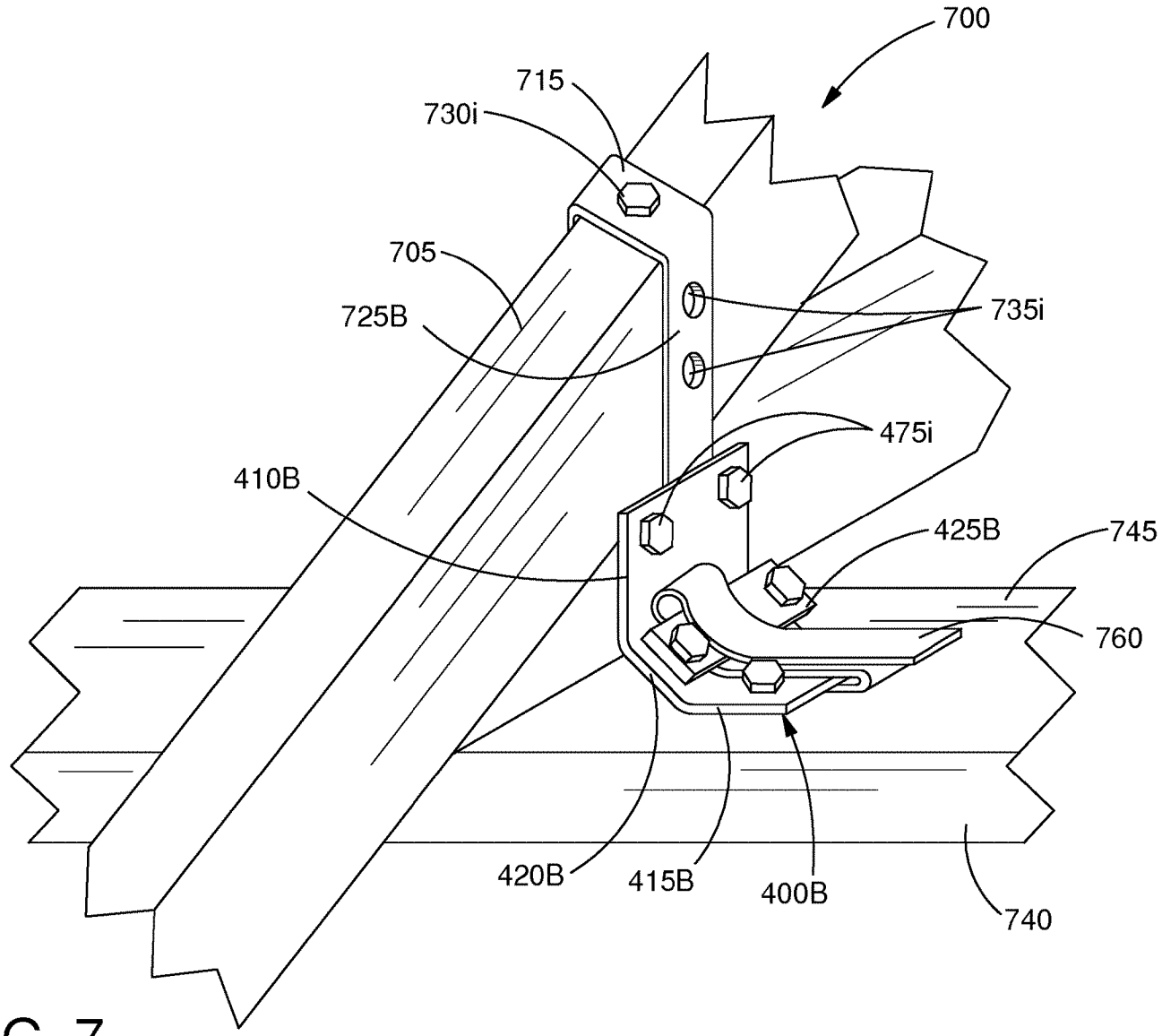
FIG. 7 depicts the system of FIGS. 5 and 6 as used to secure an angled strap to the top of load-bearing wall and to a roof truss according to one embodiment of the invention.

FIG. 7 depicts the system of FIGS. 5 and 6 as used to secure angled strap 700 to a first structural roof member, such as the top of a load-bearing wall 740, and a second structural roof member, such as a roof truss 705, according to one embodiment of the invention. In FIG. 7, only one side of roof truss 705 is shown as attached to load-bearing wall 740 using second arm 725B, second buckle 400B and second top plate 425B. First arm 720A, first buckle 400A and first top plate 425A are used in the identical manner to attach the side not shown of roof truss 705 to the top of load-bearing wall 740. In FIG. 7, second arm 725B of angled strap 700 extends vertically downward along a vertical side of roof truss 705 whereupon second free end 760 of second arm 725B of angled strap 700 is bent at substantially a right angle to extend along the top surface 745 of load-bearing wall 740. Buckle 400B is placed over second free end 760 of second arm 725B of angled strap 700. Buckle 400B is attached to the vertical side of roof truss 705 and horizontal arm 415B of buckle 400B is attached to top surface 745 of load-bearing wall 740 by placing connectors $475_i$ through holes $470_i$ in vertical arm 410B and horizontal arm 415B, pinching second free end 760 of second arm 725B of angled strap 700 between the vertical side of roof truss 705 and the top of load-bearing wall 745. Second free end 760 of second arm 760 of angled strap 700 is extended back over the exposed top surface of horizontal arm 415B toward the vertical surface of roof truss 705, whereupon top plate 425B is placed over flat connector 420B such that second free end 760 of second arm 725 of angled strap 700 is pinched between top plate 425B and flat connector 420B. Top plate 425B and flat connector 420B are then attached to the top surface of load-bearing wall 745 by suitable connectors $475_i$, such as wedge bolts, nails or screws, that extend through holes $470_i$ in top plate 425B and flat connector 420B.

Figure 8:
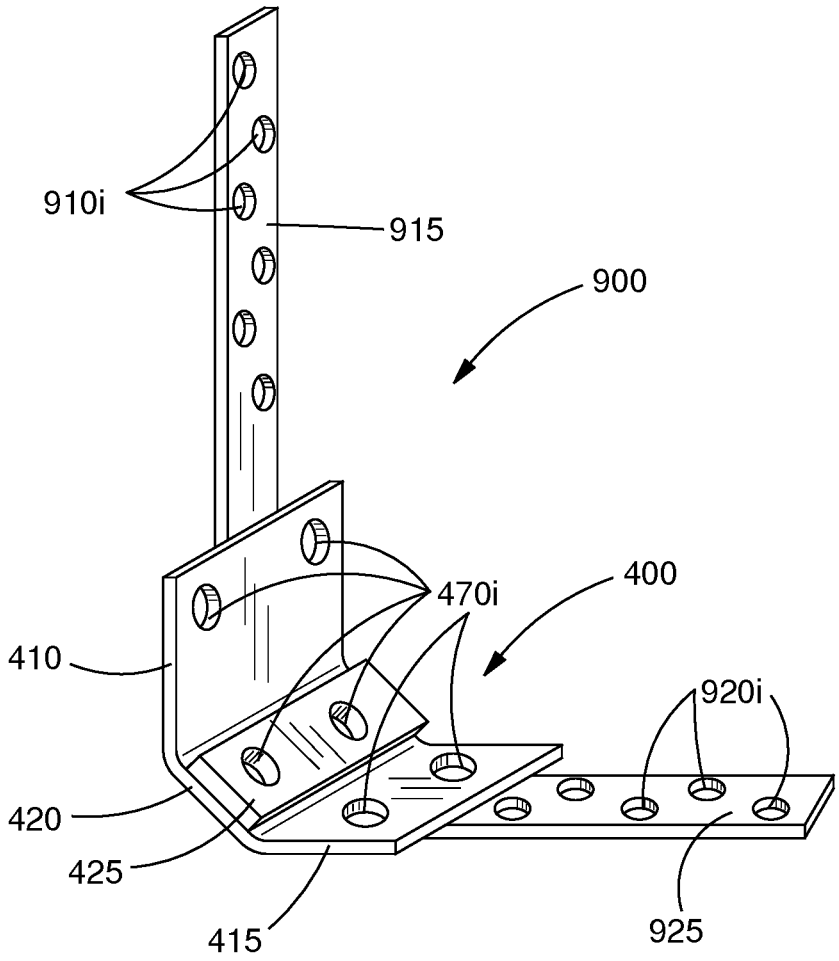
FIGS. 8 and 9 depict a system comprising a straight strap and a buckle according to one embodiment of the invention for securing a roof truss to the top of a load-bearing wall according to one embodiment of the invention.
Figure 9:
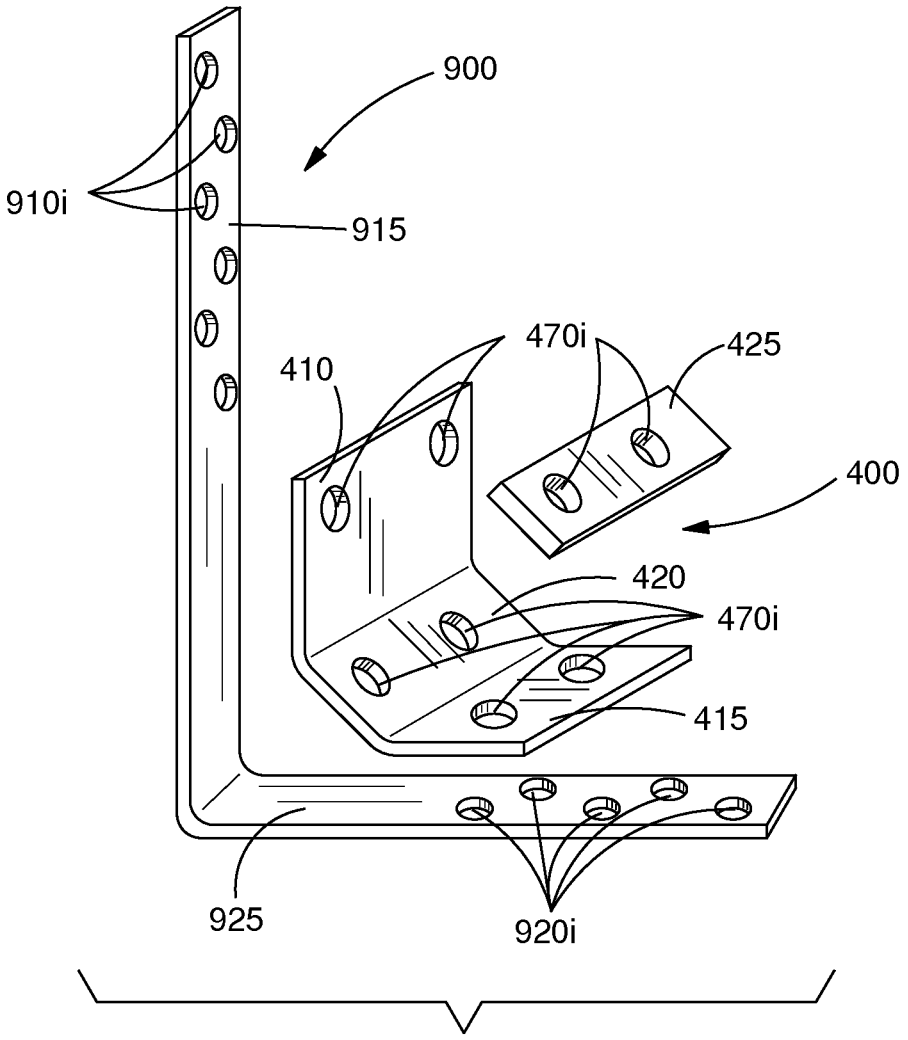

FIGS. 8 and 9 depict a system comprising a straight strap 900 and a buckle 400 according to one embodiment of the invention for securing a second structural roof member, such as a roof truss, to a first structural roof member, such as a load-bearing wall. Straight strap 900 comprises a plurality of holes $910_i$ at first end 915 and a plurality of holes $920_i$ at second end 925. Buckle 400 comprises a vertical arm 410 and a horizontal arm 415. Vertical arm 410 and horizontal arm 415 are connected by flat connector 420, which is disposed at an angle to each of vertical arm 410 and horizontal arm 415. A top plate 425 is sized to substantially mate with flat connector 420. Vertical arm 410, horizontal arm 415, flat connector 420 and top plate 425 each include a plurality of holes $470_i$ through which suitable connectors, such as wedge bolts, nails and screws, can be inserted to attach a second structural roof member, such as a roof truss, to a first structural roof member, such as a load-bearing wall.

Figure 10:
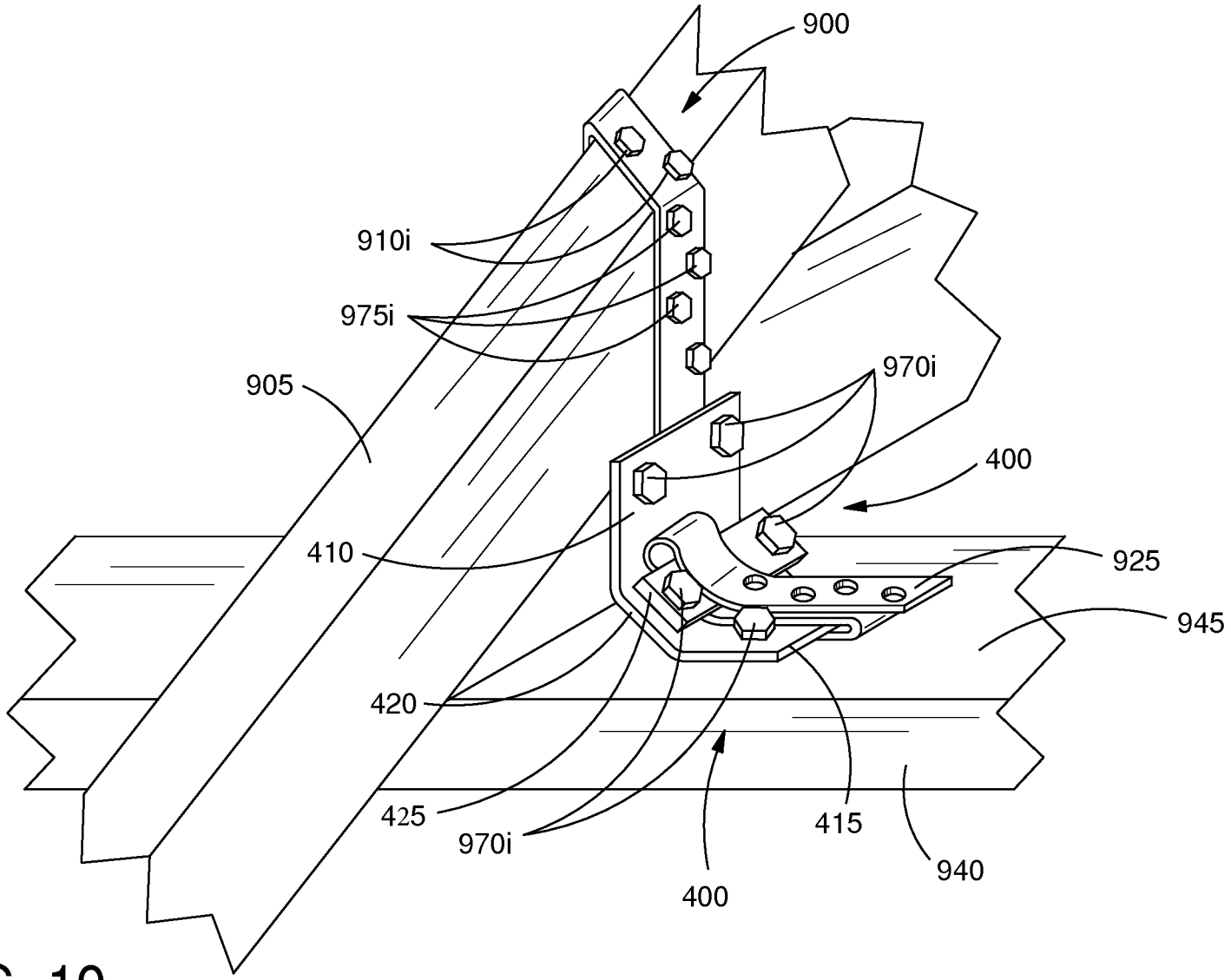
FIG. 10 depicts the system of FIGS. 8 and 9 as used to secure a roof truss to the top of a load-bearing wall according to one embodiment of the invention.

FIG. 10 depicts buckle 400 and top plate 425 as used to secure a second structural roof member, such as roof truss 905, to a first structural roof member, such as load-bearing wall 940, according to one embodiment of the invention. Straight strap 900 is attached to a vertical side of roof truss 905 by connectors $975_i$ inserted through plurality of holes $910_i$ at first end 915. Free end 925 extends vertically downward along the vertical side of roof truss 905 whereupon free end 925 of straight strap 900 is bent at substantially a right angle to then extend along the top surface 945 of load-bearing wall 940. Vertical arm 410 of buckle 400 is placed over free end 925 of straight strap 900 and horizontal arm 415 of buckle 400 is placed over free end 925 of straight strap 900. Vertical arm 410 of buckle 400 is attached to the vertical surface of roof truss 905 and horizontal arm 415 of buckle 400 is attached to top surface 945 of load-bearing wall 940, pinching free end 925 of straight strap 900. Free end 925 of straight strap 900 is extended back toward the vertical side of roof truss 905, whereupon top plate 425 is placed on flat connector 420 such that free end 925 of straight strap 900 is pinched between top plate 425 and flat connector 420. Top plate 425 is then attached to the top surface 945 of load-bearing wall 940 by suitable connectors $970_i$, such as wedge bolts, nails or screws, that extend through plurality of holes $470_i$ in top plate 425 and in flat connector 420.

The foregoing description of various embodiments of the invention has been presented for purposes of illustration and description. It is not intended to be exhaustive or to limit the invention to the precise form disclosed and, obviously, many modifications and variations are possible. While the invention has been described in terms of a roof truss and a load-bearing wall, the invention is not limited to such a purpose. Modifications and variations that may be apparent to a person skilled in the art are intended to be included within the scope of the invention as defined by the accompanying claims.

What is claimed is:

1. A system for securing a first structural roof member to a second structural roof member, comprising:

an angled strap, wherein the angled strap comprises a substantially flat angled strap comprising a flat central portion, a first arm and a second arm, wherein the first arm and the second arm are each disposed at an angle to the flat central portion, wherein the first arm comprises a first free end and the second arm comprises a second free end;

a first buckle comprising a first vertical arm and a first horizontal arm, wherein the first vertical arm and the first horizontal arm are each connected to a first flat connector, wherein the first flat connector is disposed at an angle to each of the first vertical arm and the first horizontal arm;

a first top plate sized to mate with a top surface of the first flat connector;

a second buckle comprising a second vertical arm and a second horizontal arm, wherein the second vertical arm and the second horizontal arm are each connected to a second flat connector, wherein the second flat connector is disposed at an angle to each of the second vertical arm and the second horizontal arm; and a second top plate sized to mate with a top surface of the second flat connector;

wherein a plurality of holes is disposed in each of the first vertical arm, the second vertical arm, the first horizontal arm, the second horizontal arm, the first flat connector, the second flat connector, the first top plate and the second top plate;

wherein the first free end of the angled strap is secured between a first vertical side of a first structural roof member and the first vertical arm of the first buckle; wherein the first free end of the angled strap is further secured between a top surface of a second structural roof member and the first horizontal arm of the first buckle; wherein the first free end of the angled strap is further secured between a top surface of the first flat connector and the first top plate;

wherein the second free end of the angled strap is secured between a second vertical side of a first structural roof member and the second vertical arm of the second buckle; wherein the second free end of the angled strap is further secured between a top surface of a second structural roof member and the second horizontal arm of the second buckle; wherein the second free end of the angled strap is further secured between a top surface of the second flat connector and the second top plate.

2. The system for securing a first structural roof member to a second structural roof member of claim 1, wherein the angled strap is galvanized.

3. The system of claim 1, wherein the flat central portion comprises one or more holes, wherein further each of the first arm and second arm comprise one or more holes.

4. The system of claim 3, wherein the angled strap comprises 14 gauge-20 gauge steel.

5. The system of claim 4, where the first arm and the second arm are disposed at the same angle from the flat central portion.

6. A method of securing a first structural roof member to a second structural roof member, comprising:

attaching a flat central portion of an angled strap to the top of a second structural roof member, wherein the angled strap comprises a substantially flat angled strap comprising a flat central portion, a first arm and a second arm, wherein the first arm and the second arm are each disposed at an angle to the flat central portion, wherein the first arm comprises a first free end and the second arm comprises a second free end, wherein the flat central portion comprises one or more holes, wherein further each of the first arm and second arm comprise one or more holes, wherein the angled strap comprises 14 gauge-20 gauge steel, wherein the angled strap is approximately 1 to 3 inches wide and the flat central portion is about 1½ to 3½ inches long, wherein the first arm and the second arm are disposed at the same angle from the flat central portion;

attaching a first arm of the angled strap to a first vertical side of the second structural roof member;

attaching a second arm of the angled strap to a second vertical side of the second structural roof member;

extending a first free end of the first arm of the angled strap downward along the first vertical side of the second structural roof member and thereafter extending the first free end horizontally along a top surface of a first structural roof member;

extending a second free end of the second arm of the angled strap downward along the second vertical side of the second structural roof member and thereafter extending the second free end horizontally along the top surface of the first structural roof member;

disposing a first buckle atop a top surface of the first free end of the first arm of the angled strap, wherein the first free end of the angled strap is pinched between the first vertical side of the second structural roof member and the first vertical arm, and thereafter is pinched between the top surface of the first structural roof member and the first horizontal arm;

disposing a second buckle atop a top surface of the second free end of the second arm of the angled strap, wherein the second free end of the angled strap is pinched between the second vertical side of the second structural roof member and the second vertical arm, and thereafter is pinched between the top surface of the first structural roof member and the second horizontal arm;

thereafter extending the first free end of the first arm of the angled strap along a top surface of the first horizontal arm and extending it upward along the first vertical side of the second structural roof member;

thereafter extending the second free end of the second arm of the angled strap along a top surface of the second horizontal arm and extending it upward along the second vertical side of the second structural roof member;

disposing a first top plate along a top surface of the first flat connector, wherein the first free end of the first arm is pinched between the first top plate and the first flat connector;

disposing a second top plate along a top surface of the second flat connector, wherein the second free end of the first arm is pinched between the second top plate and the second flat connector;

extending connectors through a plurality of mating holes in the first top plate and the first flat connector and attaching the first top plate and the first flat connector to the top of the first structural roof member; and extending connectors through a plurality of mating holes in the second top plate and the second flat connector and attaching the second top plate and the second flat connector to the top of the first structural roof member.

7. The method of claim 6, wherein the first structural roof member comprises a load-bearing wall and the second structural roof member comprises a roof truss.

8. The method of claim 7, wherein the first structural roof member comprises a wooden top plate or a concrete tie beam.

9. The method of claim 6, wherein the connectors comprise wedge bolts, nails or screws.

10. The method of claim 6, wherein the diameter of the connectors are larger than the diameter of the mating holes in the first flat connector and the second flat connector.

11. The method of claim 10, wherein the connectors comprise screws, wherein the diameter of the screws is ¼ inches and the diameter of the mating holes in the first flat connector and the second flat connector is 3/16 inches.

12. The method of claim 6, wherein the angled strap is galvanized.

* * * * *